US006694556B2

(12) United States Patent
Stolpmann

(10) Patent No.: US 6,694,556 B2
(45) Date of Patent: Feb. 24, 2004

(54) SELF-INFLATING MATTRESS

(75) Inventor: James R. Stolpmann, Lawrenceburg, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 105 days.

(21) Appl. No.: 10/077,007

(22) Filed: Feb. 15, 2002

(65) Prior Publication Data

US 2002/0116766 A1 Aug. 29, 2002

Related U.S. Application Data

(60) Provisional application No. 60/269,080, filed on Feb. 15, 2001.

(51) Int. Cl.[7] ..... A47C 27/10
(52) U.S. Cl. ..... 5/710; 5/713; 5/709; 5/926
(58) Field of Search ..... 5/706, 709, 710, 5/713, 644, 654, 655.3, 925

(56) References Cited

U.S. PATENT DOCUMENTS

| | | | | |
|---|---|---|---|---|
| 2,886,834 A | | 5/1959 | Gilbertson | 5/709 |
| 3,864,766 A | | 2/1975 | Prete, Jr. | 5/644 |
| 4,114,230 A | | 9/1978 | MacFarland | 15/330 |
| 4,127,906 A | | 12/1978 | Zur | 5/615 |
| 4,169,295 A | | 10/1979 | Darling | 5/706 |
| 4,306,322 A | | 12/1981 | Young et al. | 5/710 |
| 4,644,597 A | | 2/1987 | Walker | 5/711 |
| 4,679,264 A | | 7/1987 | Mollura | 5/710 |
| 4,688,283 A | | 8/1987 | Jacobson et al. | 5/710 |
| 4,724,560 A | * | 2/1988 | Christie | 5/644 |
| 4,766,628 A | | 8/1988 | Walker | 5/706 |
| 4,788,729 A | | 12/1988 | Walker | 5/711 |
| 4,803,744 A | | 2/1989 | Peck et al. | 5/713 |
| 4,807,313 A | | 2/1989 | Ryder et al. | 5/610 |
| 4,843,663 A | | 7/1989 | Horvat et al. | 5/709 |
| 4,914,762 A | | 4/1990 | Perali et al. | 5/655.3 |
| 4,953,247 A | | 9/1990 | Hasty | 5/713 |
| 4,962,552 A | | 10/1990 | Hasty | 5/713 |
| 4,982,466 A | | 1/1991 | Higgins et al. | 5/713 |
| 4,995,124 A | | 2/1991 | Wridge, Jr. et al. | 5/709 |
| 5,097,552 A | | 3/1992 | Viesturs | 5/691 |
| 5,103,519 A | | 4/1992 | Hasty | 5/715 |
| 5,142,717 A | | 9/1992 | Everard et al. | 5/709 |
| 5,144,708 A | | 9/1992 | Pekar | 137/223 |
| 5,243,722 A | * | 9/1993 | Gusakov | 5/655.3 |
| 5,304,271 A | * | 4/1994 | Gusakov | 156/145 |
| 5,323,500 A | | 6/1994 | Roe et al. | 5/710 |
| 5,325,551 A | | 7/1994 | Tappel et al. | 5/709 |

(List continued on next page.)

FOREIGN PATENT DOCUMENTS

| | | |
|---|---|---|
| CH | 659 180 A5 | 1/1987 |
| EP | 0 878 150 A2 | 11/1998 |
| GB | 0 201 589 A | 9/1988 |
| GB | 2 327 343 A | 1/1999 |
| WO | WO 93/24088 | 12/1993 |

OTHER PUBLICATIONS

AccuMax™, BG Industries, 1 pg.

SAM™ Self Adjusting Mattress, Ergocheck bed system amd ZAAM™ zoaned adjusted mattress, Atlantis Medical, including Confidential Dealer Pricing, Aug. 1998, 9 pgs..

KCI AtmosAir™, KCI The Clinical Advantage, 8 pgs.

*Primary Examiner*—Robert G. Santos
(74) *Attorney, Agent, or Firm*—Bose McKinney & Evans LLP

(57) ABSTRACT

A mattress support element comprises a fluid filled bladder and a fluid container substantially surrounded by the bladder. The fluid container is in constant fluid communication with ambient fluid outside the bladder. The fluid container is configured to deform from its original shape when an external force is applied to the bladder and to reform to its original shape upon removal of the external force from the bladder.

45 Claims, 4 Drawing Sheets

U.S. PATENT DOCUMENTS

| | | | | |
|---|---|---|---|---|
| 5,450,638 | A | | 9/1995 | Johnson ..... 5/655.3 |
| 5,469,592 | A | | 11/1995 | Johnson ..... 5/654 |
| 5,471,687 | A | | 12/1995 | Vierra ..... 5/413 AM |
| 5,539,942 | A | | 7/1996 | Melou ..... 5/655.3 |
| 5,634,224 | A | | 6/1997 | Gates ..... 5/709 |
| 5,638,565 | A | | 6/1997 | Pekar ..... 5/710 |
| 5,652,985 | A | | 8/1997 | Wilkinson et al. ..... 5/710 |
| 5,774,917 | A | * | 7/1998 | Liu ..... 5/710 X |
| 5,802,646 | A | | 9/1998 | Stolpmann et al. ..... 5/740 |
| 5,918,336 | A | * | 7/1999 | Lee et al. ..... 5/713 |
| 6,212,718 | B1 | | 4/2001 | Stolpmann et al. ..... 5/713 |
| 6,286,167 | B1 | | 9/2001 | Stolpmann ..... 5/737 |
| 6,463,610 | B1 | * | 10/2002 | Shulte et al. ..... 5/710 X |
| 2002/0116766 | A1 | * | 8/2002 | Stolpmann ..... 5/710 |

* cited by examiner

SELF-INFLATING MATTRESS

This application claims the benefit of U.S. Provisional Application Serial No. 60/269,080, filed Feb. 15, 2001, which is expressly incorporated by reference herein.

BACKGROUND AND SUMMARY OF THE INVENTION

The present invention relates to a mattress structure. More particularly, the present invention relates to a mattress structure including a plurality of self-inflating air bladders.

In one illustrated embodiment of the present invention, a mattress support element comprises a fluid filled bladder and a fluid container substantially surrounded by the bladder. The fluid container is in constant fluid communication with ambient fluid outside the bladder. The fluid container is configured to deform from its original shape when an external force is applied to the bladder and to reform to its original shape upon removal of the external force from the bladder.

Illustratively, the bladder is sealed to prevent fluid leakage from the bladder. In one illustrated embodiment, the fluid container has an outer wall that reforms to its original shape automatically after the external force is removed from the bladder. In another illustrated embodiment, an elastic compressible member is located inside the fluid container. The elastic compressible member illustratively includes at least one of a foam material, a woven thermoplastic material, a plurality of spring elements, and a bellows. In yet another embodiment, an elastic compressible material is also located inside the bladder and substantially surrounding the fluid container.

In another illustrated embodiment, the bladder has an outer wall, a radially spaced apart inner wall, and first and second end walls that seal the bladder. The inner wall is configured to define an opening through the bladder which provides the fluid container. A removable insert formed from an elastic compressible material is illustratively located in the opening.

In a further illustrated embodiment, the bladder includes first and second spaced apart end walls configured to define first and second fluid containers at opposite ends of the bladder which are substantially surrounded by the bladder. The support element further comprises means for adjusting a volume of the first and second fluid containers as the external force is applied to the bladder. In one illustrated embodiment, the adjusting means includes an elastic member located inside the bladder. The elastic member has first end coupled to the first end wall of the bladder and a second end coupled to the second end wall of the bladder. In another illustrated embodiment, the adjusting means includes first and second compressible elastic members located in the first and second fluid containers, respectively, the elastic members being in communication with ambient air.

In another illustrated embodiment, a mattress support element comprises a fluid-filled bladder, the bladder being sealed to prevent fluid leakage from the bladder, and a fluid chamber at least partially surrounded by the bladder. The fluid chamber is in fluid communication with ambient air. The support element also includes an elastic member located in the fluid chamber.

In yet another illustrated embodiment, a mattress comprises a cover configured to define an interior region, and a mattress core located in the interior region. The mattress core includes a plurality of support elements. At least one of the support elements includes a fluid filled bladder and a fluid container substantially surrounded by the bladder. The fluid container is in constant fluid communication with ambient fluid outside the bladder. The fluid container is also configured to deform from its original shape when an external force is applied to the bladder and to reform to its original shape upon removal of the external force from the bladder to regulate pressure of the support element.

In an illustrated embodiment, a shear liner is located over the mattress core and beneath the cover. In another illustrated embodiment, the mattress core includes a shear material formed to provide a plurality of adjacent sleeves. A support element is located in each of the plurality of sleeves.

Additional features of the present invention will become apparent to those skilled in the art upon consideration following detailed description of illustrated embodiments exemplifying the best mode of carrying out the invention as presently perceived.

BRIEF DESCRIPTION OF THE DRAWINGS

The detailed description refers to the accompanying figures in which.

DETAILED DESCRIPTION OF THE DRAWINGS

Figure 1:
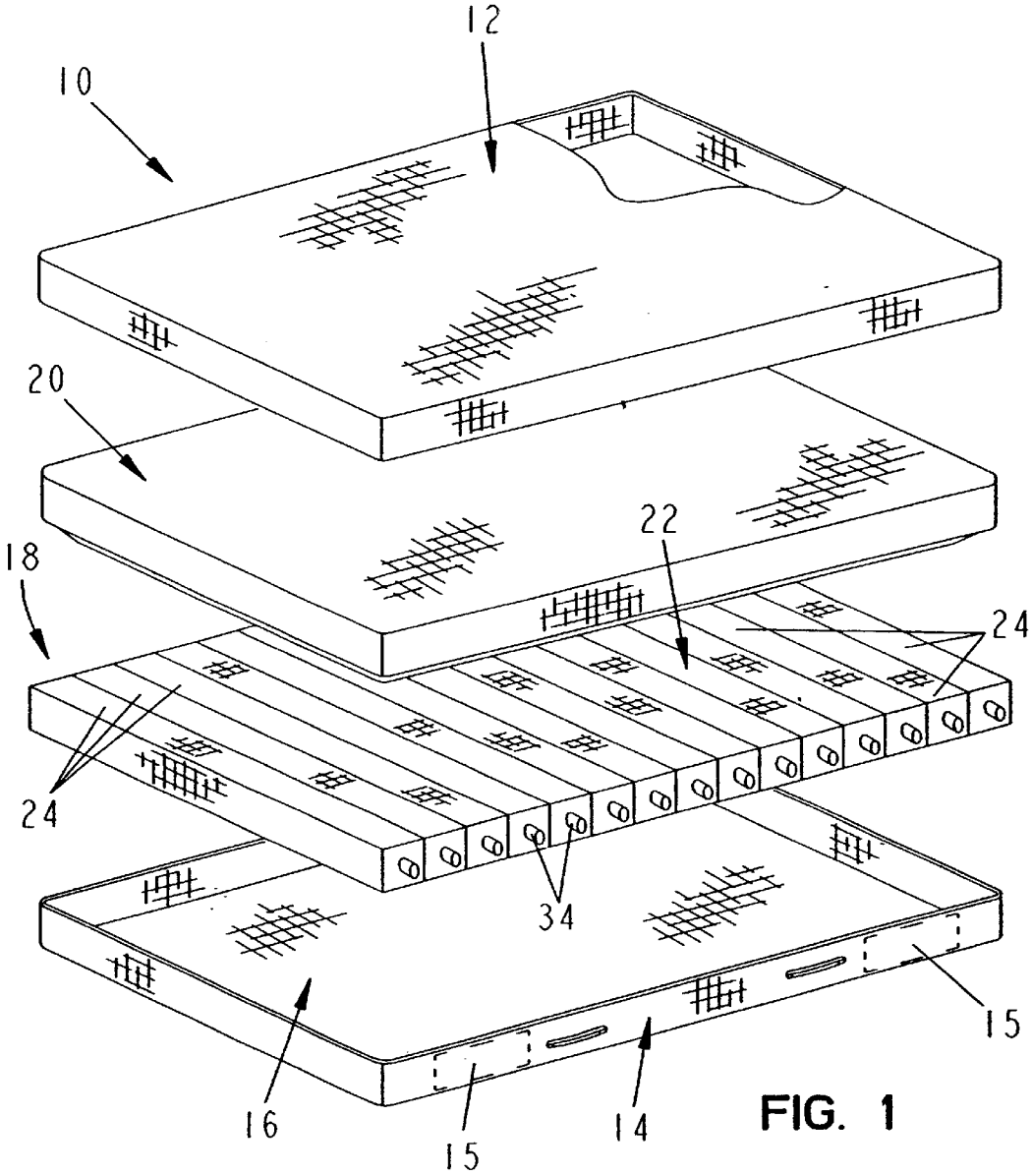
FIG. 1 is an exploded perspective view of a mattress of the present invention including a mattress core having plurality of self-inflating air bladders.

Referring now to the drawings, FIG. 1 illustrates a mattress structure 10 of the present invention. In the illustrated embodiment, mattress 10 includes a top cover 12 and a bottom cover 14. Top and bottom covers 12 and 14 are configured to be coupled together in a conventional manner to define an interior region 16 between the top and bottom covers 12 and 14. Covers 12 and 14 may include optional vents 15 that are illustratively air permeable but liquid impermeable. Vents 15 permit air to flow through the cover 12, 14 while preventing patient liquids from entering the interior region of the mattress 10. A mattress core 18 is illustratively located in interior region 16. A shear liner 20 is illustratively located between mattress core 18 and top cover 12 to reduce friction between the top surface 22 of the mattress core 18 and the top cover 12, thereby reducing shear forces on a body situated on the mattress 10.

Figure 9:
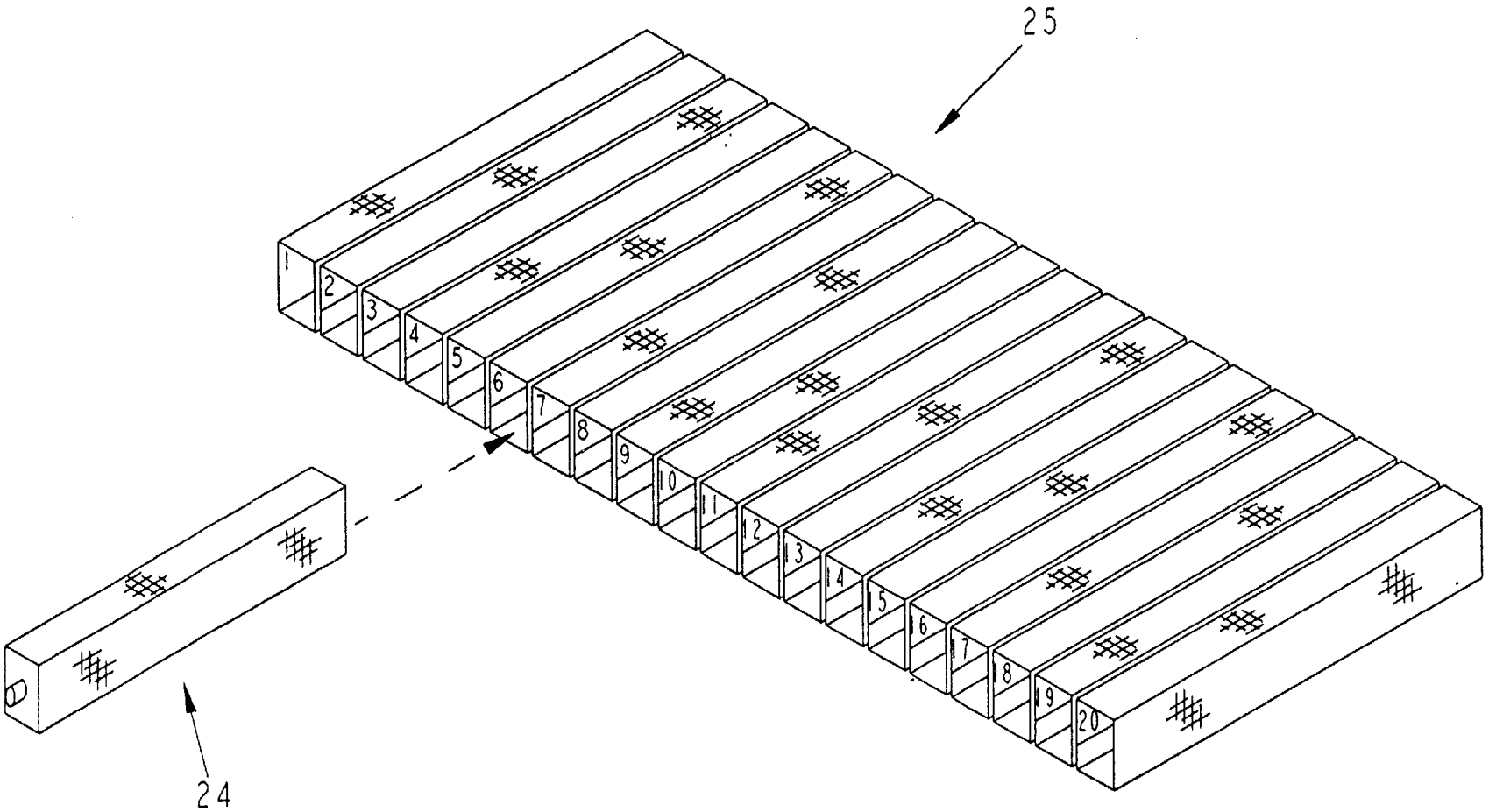
FIG. 9 is a perspective view of an alternative embodiment of a mattress core of the present invention.

In the illustrated embodiment, mattress core 18 includes a plurality of separate air bladders 24 extending transversely across a width of the mattress core 18. Air bladders 24 may be grouped to create separate mattress zones. The grouped bladders 24 may be of a different length and stiffness than other grouped bladders 24. The differences in length and stiffness allow the zones to be tailored to the pressure relief needs of different areas of a patient's body. In one embodiment, each bladder 24 is coupled to adjacent bladders 24 by tethers, RF welds, buttons, snaps, ties or the like to form an array of bladders 24. In another embodiment, as shown in FIG. 9, bladders 24 are located in fabric sleeves 25 made of shear material such as shown, for example in U.S. Pat. Nos. 5,802,646; 6,212,718; and 6,286,167 and in U.S. application Ser. No. 10/044,410, the disclosures of which are incorporated by reference.

It is understood that other support elements (not shown) such as foam layers, additional air bladders, gel layers, other fluid filled layers, or the like may be situated within the interior region 16 above or below mattress core 18. Bladders 24, individually or in groups, may be situated within the foam layers, gel layers, or the like. In addition, the bladders 24 may be oriented to extend longitudinally within the mattress core 18.

The plurality of air bladders 24 are configured to be self-inflating to a desired pressure to support a body on the mattress 10. Therefore, the plurality of bladders 24 support the body without requiring a separate air supply to be coupled to the bladders 24 to maintain inflation of the air bladders. The bladders 24 also provide pressure relief when a load or external force is applied to the bladders 24.

Figure 2:
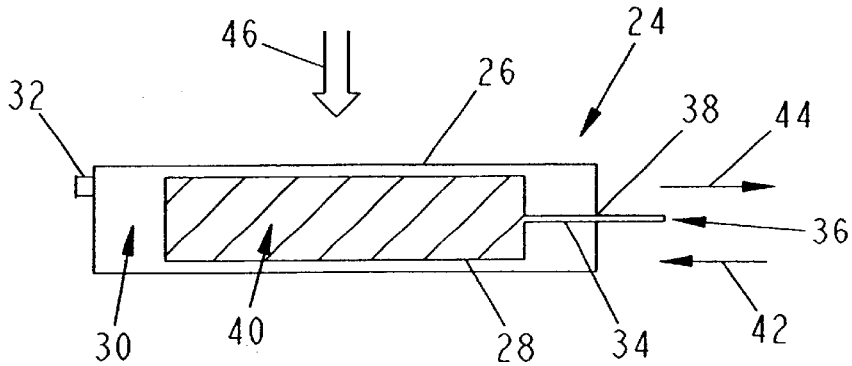
FIG. 2 is a diagrammatical view illustrating a first embodiment of a self-inflating air bladder of the present invention.

One embodiment of the air bladders 24 of the present invention is illustrated in FIG. 2. The FIG. 2 air bladder 24 includes an outer sealed bladder 26. An inner self-inflating bladder 28 is located within an interior region 30 of outer bladder 26. Air bladder 26 is either sealed by the manufacturer or includes a removable cap 32 to permit the bladder 26 to be initially inflated to a desired pressure. The cap 32 is then replaced to seal the bladder 26. The outer bladder 26 is preferably made from a compliant and soft material so as to allow a large surface contact area with a patient thereon. Inner bladder 28 may be coupled to a portion of an inner wall of outer bladder 26, if desired. Inner bladder 28 can be either directly coupled to bladder 26 or connected by baffles, tethers or other suitable connectors. An air vent tube 34 is coupled to inner bladder 28. Air vent tube 34 includes an open end 36. Therefore, vent tube 34 is not restricted by a flow control valve or other obstruction. Outer bladder 26 is sealed to air vent tube at location 38 to maintain pressure in the outer bladder 26.

The inner self-inflating bladder 28 is illustratively filled with an elastic member 40. Illustratively, elastic member 40 is a porous, elastic, and compressible material such as a reticulated foam material 40 or other suitable material. The material 40 has the property of returning to its original size, shape, or position after being squeezed or deformed by a compression force once the compression force is removed. The elastic member 40 may also be formed from a woven thermoplastic material, a plurality of spring elements, a bellows, or other suitable structure.

In another embodiment, the inner bladder 28 is constructed from plastic, rubber, or material the like that has been pre-molded to have shape memory. Such a memory allows the bladder 28 to be self-restoring when an external force is removed. Therefore, the outer wall of bladder is initially deformed by an external force, but then reforms to its original shape automatically after the external force is removed from the bladder to refill the bladder 28 with fluid. In this embodiment, the separate elastic member 40 is not required.

Air flows into inner bladder 28 through vent tube 34 in the direction of arrow 42. Air can also freely flow out of inner bladder 28 through vent tube 34 in the direction of arrow 44. Air inhaled into or expelled from tubes 34 of the bladders 28 comes from ambient air passing through a ticking zipper connecting top and bottom covers 12 and 14 or through vents 15 provided in top cover 12 or bottom cover 14. In the illustrated embodiment, outer bladder 26 is initially filled with air at or near atmospheric pressure. The material 40 within inner bladder 28 along with the self-restoring properties of the inner bladder 28 cause inner bladder 28 to self-inflate through vent tube 34 when no load is applied to bladder 24. Characteristics of the material 40 and/or the memory of the bladder 28 determine the amount of air that is exhausted from inner bladder 28 as a load as applied to the outer bladder 26 in the direction of arrow 46. When an external force is applied to the outer bladder 26, such as when a body is positioned on bladder 26, pressure in the interior region 30 increases and squeezes the inner bladder 26 causing air to escape in the direction of arrow 44, thereby and reducing the volume of the inner bladder 28. Reduction of volume of inner bladder 28 regulates the pressure in interior region 30 of air bladder 24 as a load is applied. Therefore, the bladder 24 acts to reduce pressure on the body located on the bladder 24 to reduce the risk of pressure ulcers on the body. The rate of pressure change and the final equilibrium pressure in bladder 24 are controlled by the volume and stiffness of the material 40 and bladder 28. By varying the initial volume in inner bladder 28 and the stiffness and compressed volume of the material 40, the equilibrium pressure of bladder 24 is regulated to a customized internal pressure.

When the force in the direction of arrow 46 is removed, material 40 expands to re-inflate the inner bladder 28. The characteristics of inner bladder 28 and material 40 can be altered to achieve the desired load/deflection response characteristics. Typically, the load/deflection response characteristics are customized to minimize interface pressures with a patient and to prevent a patient from "bottoming out", or completely compressing the bladder 24. Mattress 10 is designed to provide a controlled volumetric change with a corresponding pressure change to allow proper displacement and supporting force.

Figure 3:
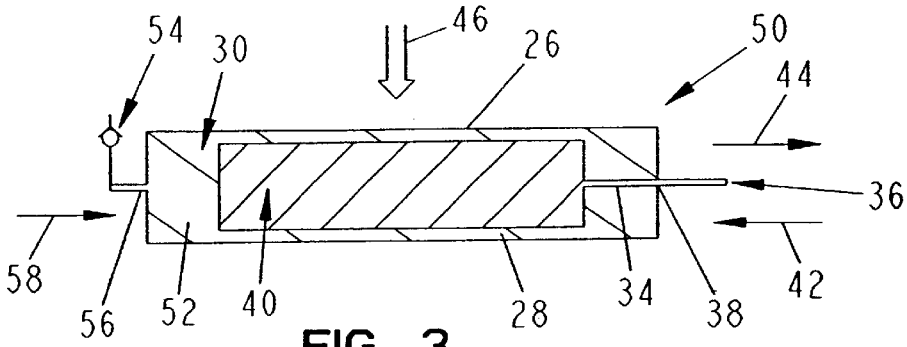
FIG. 3 is a sectional view taken through an air bladder of another embodiment of the present invention.

Another embodiment of a bladder 50 is provided which may be used in mattress core 18 is shown in FIG. 3. The FIG. 3 embodiment is similar to FIG. 2. Those elements referenced by numbers identical to FIG. 2 perform the same or similar function. In the FIG. 3 embodiment, a porous, elastic and compressible material 52 is also located within interior region 30 of outer bladder 26 surrounding inner bladder 28. For example, material 52 is a reticulated foam or other similar material.

A check valve 54 is coupled to an inlet tube 56 of outer bladder 26. Check valve 54 permits air to enter the interior region 30 of outer bladder 26 in the direction of arrow 58, but prevents air from escaping from outer bladder 26. Air bladder 50 does not require leak tightness which is desirable for bladder 24 of FIG. 2. If outer bladder 26 becomes under inflated, the material 52 expands to draw air into the interior region 30 of outer bladder 26 in the direction of arrow 58.

Pressure within bladder 50 is regulated in a manner similar to the manner discussed above with regard to FIG. 2. When a load is applied to the bladder 50 in the direction of arrow 46, pressure within interior region 30 increases and squeezes inner bladder 28 to exhaust air in the direction of arrow 44. When the load is removed, material 40 expands to draw air into the inner bladder 28 in the direction of arrow 42. Again, the stiffness and compressed volume of material 40 is selected to customize the desired equilibrium pressure within bladder 50.

In another embodiment of the present invention, the inner bladder 28 of FIGS. 2 and 3 is coupled to a pressure regulating valve which controls the flow of air out of the inner bladder 28. When the pressure in the inner bladder 28 exceeds a predetermined threshold pressure of the regulating valve, air is exhausted from the bladder 28. In this embodiment, a check valve is also coupled to the inner bladder 28. The check valve permits air to flow into the inner bladder 28 but prevents air from flowing out of the bladder 28. Therefore, the inner bladder 28 is inflated through the check valve when the load is removed from the bladder 24 or 50 in these alternative embodiments.

Figure 4:
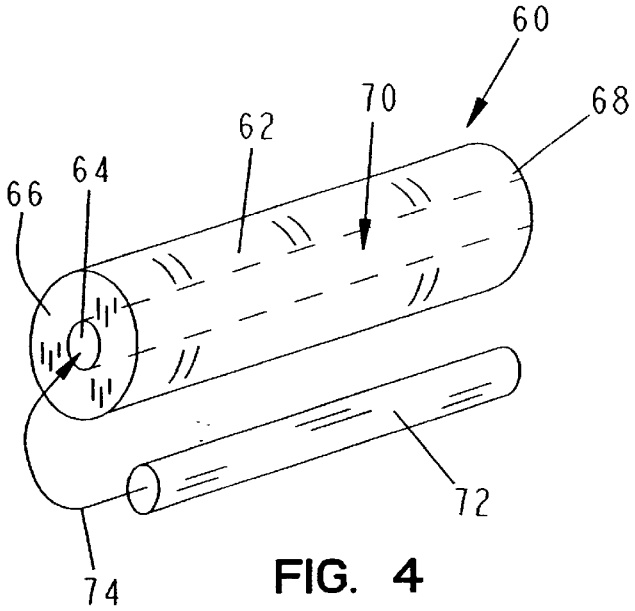
FIG. 4 is an exploded perspective view of yet another air bladder of the present invention.
Figure 5:
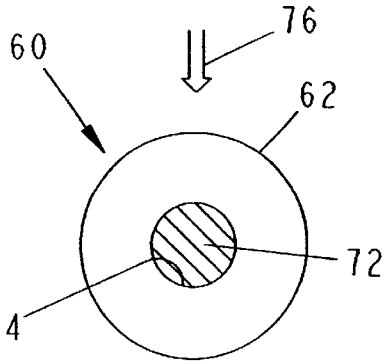
FIG. 5 is a sectional view taken through the air bladder of FIG. 4.

Another embodiment of an air bladder of the present invention is illustrated in FIGS. 4 and 5. Bladder 60 is illustratively cylindrically shaped and includes an outer wall 62, an inner wall 64, and end walls 66 and 68 which are sealed to the outer and inner walls 62 and 64 to provide a sealed air bladder 60 having a longitudinally extending central opening 70 which is open to atmosphere. A cylindrical insert 72 is configured to be inserted into the opening 70 in the direction of arrow 74. FIG. 5 illustrates the insert 72 located within the opening 70. Illustratively, insert 72 is made from a porous, elastic compressible material such as reticulated foam or other type of material which compresses when a load is applied and expands back to its original volume when the load is removed. The stiffness and compressed volume of the insert 72 controls the final equilibrium pressure of bladder 60. As a load is applied to bladder 60 in the direction of arrow 76 in FIG. 5, the foam insert 72 is compressed as air escapes through the open ends of opening 70 of bladder 60. As load 76 is removed, the insert 72 expands so that the bladder 60 returns back to its equilibrium pressure.

Figure 6:
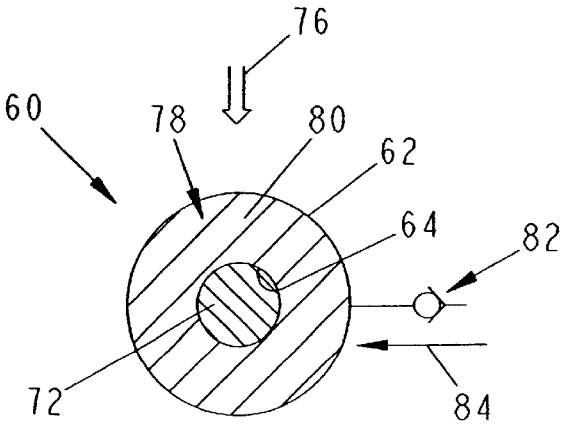
FIG. 6 is a sectional view similar to FIG. 5 illustrating yet another embodiment of the present invention.

Another embodiment of the present invention is illustrated in FIG. 6. The FIG. 6 embodiment is similar to the embodiment illustrated in FIGS. 4 and 5. Those elements referenced by numbers identical to FIGS. 4 and 5 perform the same or similar function. However, in the FIG. 6 embodiment a porous, elastic compressible material such as reticulated foam or other type of suitable material 80 is located within the interior region of bladder 60 between outer wall 62 and inner wall 64. A check valve 82 is also coupled to bladder 60 to permit air from the atmosphere to flow into the interior region 78 of bladder 60 in the direction of arrow 84. The check valve 82 and material 80 keep the interior region 78 of bladder 60 full of air. Therefore, an air tight seal is not necessary in FIG. 6 embodiment.

In the embodiment FIGS. 5 and 6, the insert 72 may be removed from the central opening 70 in desired portions of the mattress core 18 in order to reduce pressure in certain areas of the mattress such as below the heels of a patient lying on the mattress. Therefore, pressure can be customized by either totally removing the inserts 72 or by customizing the stiffness and compressed volume of the inserts 72.

Figure 7:
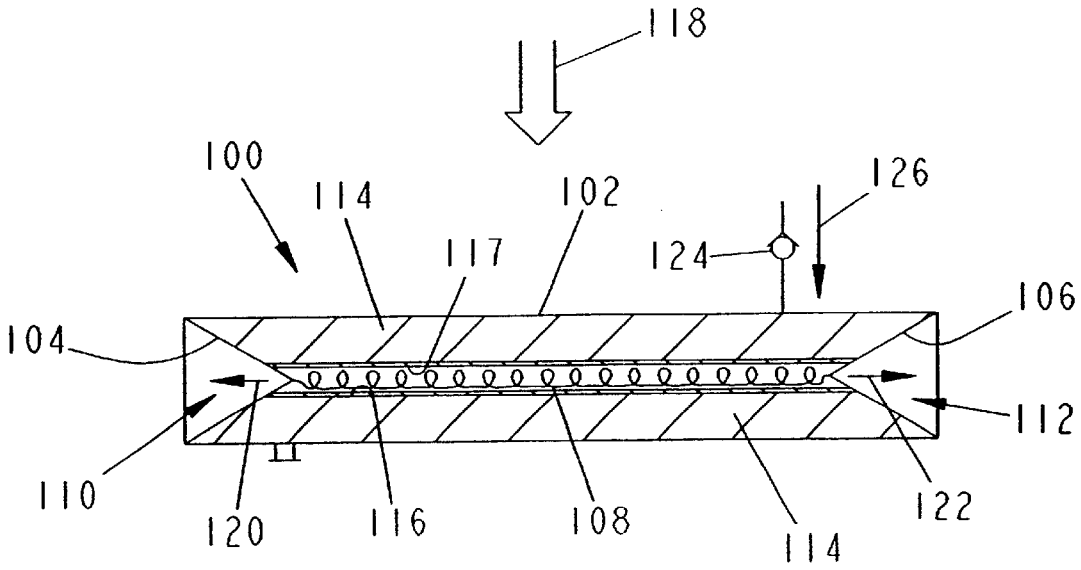
FIG. 7 is a sectional view taken through an additional embodiment of the present invention.

Yet another embodiment of the present invention is illustrated in FIG. 7. The FIG. 7 bladder 100 includes an outer surface 102 and end walls 104 and 106 which are coupled together by an internal tension member 108. Illustratively, tension member 108 is a bungee cord, spring, or other suitable elastic member. Tension member 108 pulls end walls 104 and 106 inwardly to form expansion chambers 110 and 112, respectively, at opposite ends of bladder 100.

A porous elastic compressible material 114 is located within interior region of bladder 100. Material 114 illustratively includes a longitudinally extending opening 116 configured to receive the tension member 108 therein. If necessary, an optional flexible, non-compressible tube 117 is located in opening 116 to prevent material 114 from collapsing on tension member 108. The material 114 maintains its initial shape when no load is applied to the bladder 100.

Tension member 108 illustratively has a tensile force of about zero until the bladder 100 is loaded with a force. When a load is applied in a direction of arrow 118, the interior region of bladder 100 is compressed which causes end walls 104 and 106 to expand outwardly in the direction of arrows 120 and 122, respectively, against the force of tension member 108. The stiffness of tension member 108 determines the pressure characteristics of bladder 100. Illustratively, stiffer tension members 108 are used in sections of the mattress core 18 experiencing higher loads, such as in the seat section. Other elastic tension members 108 are used in sections of mattress core 18 in which reduced pressure is desired, such as in the heel zone of the mattress core 18. The tension member 108 affects the load/deflection properties of the bladder 100 and may be adjusted as desired.

In other words, outward expansion of the end walls 104 and 106 in the direction of arrows 120 and 122, respectively, is controlled by the stiffness and elongation of the tension member 108. Equilibrium pressure within the bladder 108 is determined by the controlled expansion of the end walls 104 and 106. By varying the spring rate of the tension member 108, the equilibrium pressure within the bladder 100 may be customized. When the load in the direction of arrow 18 is removed, tension member 108 pulls end walls 104 and 106 inwardly to the position shown in FIG. 7 to inflate the bladder 100 to its equilibrium pressure.

In another embodiment of the FIG. 7 bladder 100, an optional check valve 124 is coupled to outer surface 102. Check valve 124 permits air to be drawn into the interior region of bladder 100 in the direction of arrow 126 as the bladder 100 returns to its FIG. 7 position after the load is removed.

Figure 8:
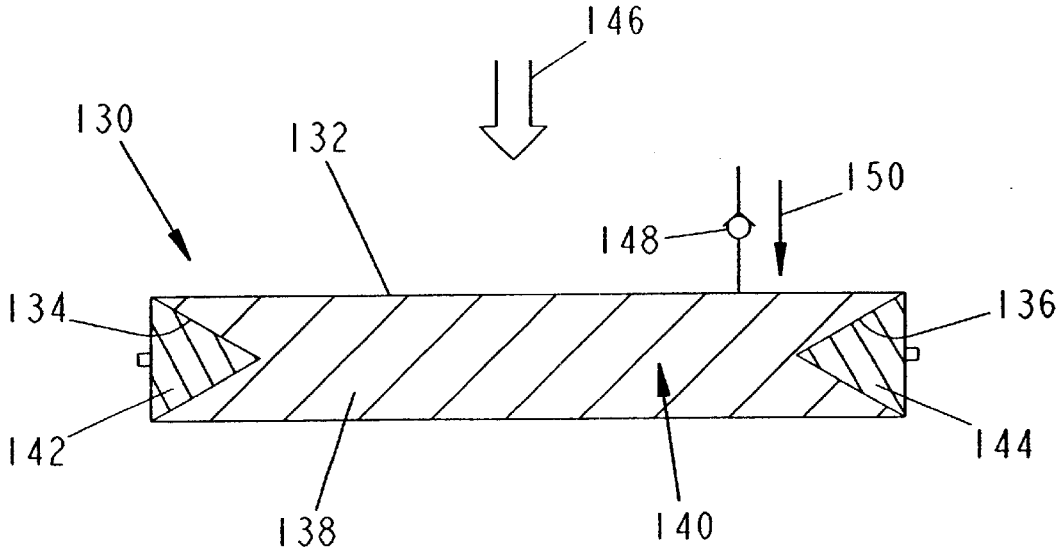
FIG. 8 is a sectional view taken through a further embodiment of the present invention.

Yet another embodiment of the present invention is illustrated in FIG. 8. The FIG. 8 embodiment includes a bladder 130 having a generally cylindrically shaped outer wall 132 and end walls 134 and 136. End walls 134 and 136 have a generally conical shape. A porous, elastic compressible material 138 is located within an interior region 140 of bladder 130. Compressible members 142 and 144 are located adjacent to end walls 134 and 136, respectively. The conically shaped members 142 and 144 are illustratively made from a porous, elastic compressible material such as reticulated foam or other suitable material. When a load is applied to bladder 130 in the direction of arrow 146, compressible members 142 and 144 are compressed. Illustratively, compressible members 142 and 144 are vented to atmosphere. Therefore, expansion of end walls 134 and 136 of bladder 130 is controlled by compressing compressible members 142 and 144 instead of using an internal tension member 108 as in the FIG. 7 embodiment. When the load 146 is removed, compressible members 142 and 144 expand to their predetermined shapes so that the bladder 130 returns to its equilibrium pressure.

In an alternative embodiment of FIG. 8, an optional check valve 148 is coupled to the outer wall 132 so that air can flow from the atmosphere into interior region 140 in the direction of arrow 150. Therefore, air can enter interior region 140 of bladder 130 when the load is removed so that the bladder 130 returns to its equilibrium pressure.

Although the invention has been described in detail with reference to certain illustrated embodiments, variations and modifications exist within the scope and spirit of the invention as described and defined in the following claims.

What is claimed is:

1. A mattress support element comprising:

a fluid filled bladder, and a fluid container substantially surrounded by the bladder, the fluid container being in constant fluid communication with ambient fluid outside the bladder, the fluid container being configured to deform from its original shape when an external force is applied to the bladder and to reform to its original shape upon removal of the external force from the bladder.

2. The mattress support element of claim 1, wherein the bladder is sealed to prevent fluid leakage from the bladder.

3. The mattress support element of claim 1, further including a fluid intake valve coupled to the bladder.

4. The mattress support element of claim 3, wherein the container is self-inflating.

5. The mattress support element of claim 1, further comprising an elastic compressible member located inside the fluid container.

6. The mattress support element of claim 5, wherein the elastic compressible member includes at least one of a foam material, a woven thermoplastic material, a plurality of spring elements, and a bellows.

7. The mattress support element of claim 1, further comprising an elastic compressible material located inside the bladder and substantially surrounding the fluid container.

8. The mattress support element of claim 1, further comprising a fluid transfer member configured to vent the fluid container to the ambient fluid through the bladder, and wherein both intake and outflow of fluid to and from the fluid container occurs through the fluid transfer member.

9. The mattress support element of claim 8, wherein the fluid transfer member is unobstructed.

10. The mattress support element of claim 1, wherein the bladder has a generally rectangular cross-sectional shape.

11. The mattress support element of claim 1, wherein the bladder has a generally circular cross-sectional shape.

12. The mattress support element of claim 1, wherein pressure in the bladder is regulated by adjusting the fluid volume in the fluid container as the external force is applied to the bladder.

13. The mattress support element of claim 1, wherein an interior volume of the bladder is separate from an interior volume of the fluid container.

14. The mattress support element of claim 1, wherein the bladder has an outer wall, a radially spaced apart inner wall, and first and second end walls that seal the bladder, the inner wall being configured to define an opening through the bladder which provides the fluid container.

15. The mattress support element of claim 14, further comprising a removable insert located in the opening.

16. The mattress support element of claim 15, wherein the insert is formed from an elastic compressible material.

17. The mattress support element of claim 1, further comprising means located in the fluid container for controlling a volume of the fluid container as the external force is applied to the bladder.

18. The mattress support element of claim 1, wherein the fluid container has an outer wall that reforms to its original shape automatically after the external force is removed from the bladder.

19. The mattress support element of claim 1, wherein the bladder includes first and second spaced apart end walls configured to define first and second fluid containers at opposite ends of the bladder which are substantially surrounded by the bladder, and further comprising means for adjusting a volume of the first and second fluid containers as the external force is applied to the bladder.

20. The mattress support element of claim 19, wherein the adjusting means includes an elastic member located inside the bladder, the elastic member having a first end coupled to the first end wall of the bladder and a second end coupled to the second end wall of the bladder.

21. The mattress support element of claim 20, further comprising a tube extending between the first and second end walls of the bladder, the elastic member being located in the tube.

22. The mattress support element of claim 19, wherein the adjusting means includes first and second compressible elastic members located in the first and second fluid containers, respectively, the elastic members being in communication with ambient air.

23. The mattress support element of claim 19, wherein the first and second fluid containers are generally conically shaped.

24. A mattress support element comprising:

a fluid-filled bladder, the bladder being sealed to prevent fluid leakage from the bladder;

a fluid chamber at least partially surrounded by the bladder, the fluid chamber being in fluid communication with ambient air, and an elastic member located in the fluid chamber.

25. The mattress support element of claim 24, wherein the fluid chamber is an inner bladder sealed within the bladder and includes a vent tube configured to provide fluid communication between the inner bladder and ambient fluid.

26. The mattress support element of claim 24, wherein an interior volume of the bladder is separate from an interior volume of the fluid chamber.

27. The mattress support element of claim 24, wherein the elastic member includes at least one of a foam material, a woven thermoplastic material, a plurality of spring elements, and a bellows.

28. The mattress support element of claim 24, further comprising an elastic compressible material located inside the bladder and substantially surrounding the fluid chamber.

29. The mattress support element of claim 24, further comprising a fluid transfer member configured to vent the fluid chamber to the ambient fluid through the bladder, and wherein intake and outflow of fluid to and from the fluid chamber both occur through the fluid transfer member.

30. The mattress support element of claim 29, wherein the fluid transfer member is unobstructed.

31. The mattress support element of claim 24, wherein the bladder has an outer wall, a radially spaced apart inner wall, and first and second end walls that seal the bladder, the inner wall being configured to define an opening through the bladder which provides the fluid chamber.

32. The mattress support element of claim 31, wherein the elastic member is a removable insert located in the opening.

33. The mattress support element of claim 24, wherein the bladder includes first and second spaced apart end walls configured to define first and second fluid chambers at opposite ends of the bladder which are substantially surrounded by the bladder, and the elastic member has a first end coupled to the first end wall of the bladder and a second end coupled to the second end wall of the bladder.

34. The mattress support element of claim 24, wherein the bladder includes first and second spaced apart end walls configured to define first and second fluid chambers at opposite ends of the bladder which are substantially surrounded by the bladder, and the elastic member includes first and second compressible elastic members located in the first and second fluid chambers, respectively, the first and second elastic members being in communication with ambient air.

35. A mattress comprising:

a cover configured to define an interior region; and a mattress core located in the interior region, the mattress core including a plurality of support elements, the support elements including a fluid filled bladder and a fluid container substantially surrounded by the bladder, the fluid container being in constant fluid communication with ambient fluid outside the bladder, the fluid container being configured to deform from its original shape when an external force is applied to the bladder and to reform to its original shape upon removal of the external force from the bladder to regulate pressure of the support element.

36. The mattress of claim 35, further comprising a shear liner located over the mattress core and beneath the cover.

37. The mattress of claim 35, wherein the mattress core includes a shear material formed to provide a plurality of adjacent sleeves, a support element being located in each of the plurality of sleeves.

38. The mattress of claim 35, wherein the bladder of each support element is sealed to prevent fluid leakage from the bladder.

39. The mattress of claim 35, further comprising an elastic compressible member located inside each fluid container.

40. The mattress of claim 39, wherein the elastic compressible member includes at least one of a foam material, a woven thermoplastic material, a plurality of spring elements and a bellows.

41. The mattress element of claim 35, wherein the bladder of at least one support element has an outer wall, a radially spaced apart inner wall, and first and second end walls that seal the bladder, the inner wall being configured to define an opening through the bladder which provides the fluid container.

42. The mattress of claim 41, further comprising a removable insert located in the opening.

43. The mattress of claim 35, further comprising means located in the dry fluid container for controlling a volume of the fluid container as the external force is applied to the bladder to regulate pressure within the bladder.

44. The mattress of claim 35, wherein at least one support element includes a fluid transfer member configured to vent the fluid container to the ambient fluid through the bladder, and wherein intake and outflow of fluid to and from the fluid container both occur through the fluid transfer member.

45. The mattress of claim 35, wherein the bladder of at least one support element includes first and second spaced apart end walls configured to define first and second fluid containers at opposite ends of the bladder substantially surrounded by the bladder, and further comprising means for adjusting a volume of the first and second fluid containers as the external force is applied to the bladder.

* * * * *